US005452853A

United States Patent [19]

Shook et al.

[11] Patent Number: 5,452,853

[45] Date of Patent: Sep. 26, 1995

[54] METHOD AND APPARATUS FOR SPRAYING GROUT ONTO THE INTERIOR SURFACE OF AN ENCLOSED ELONGATED CAVITY

[75] Inventors: William E. Shook, Johnston; Danny C. Jury, Ankeny, both of Iowa; Carroll O. Trimble, Springdale, Ak.

[73] Assignee: Action Products Marketing Corporation, Johnston, Iowa

[21] Appl. No.: 237,657

[22] Filed: May 4, 1994

[51] Int. Cl.[6] ..... B05B 3/10; B05B 17/04

[52] U.S. Cl. ..... 239/7; 239/224; 239/227; 239/263; 239/289; 118/317

[58] Field of Search ..... 239/7, 222.11, 239/223, 224, 227, 240, 263, 263.1, 264, 289, 461, 498, 505, 390; 118/DIG. 10, 317, 323, 302; 134/167 R, 167 C, 168 R, 168 C

[56] References Cited

U.S. PATENT DOCUMENTS

| | | | |
|---|---|---|---|
| 3,034,729 | 5/1962 | Gray et al. | 239/7 X |
| 3,455,728 | 7/1969 | Kiwiet | 118/317 X |
| 3,459,586 | 8/1969 | Kiwiet et al. | 118/317 X |
| 3,460,988 | 8/1969 | Kennedy, Jr. et al. | 239/227 X |
| 4,233,932 | 11/1980 | Blakeslee | 118/317 X |
| 4,337,897 | 7/1982 | Höffken et al. | 239/227 X |
| 4,414,918 | 11/1983 | Nelson Holland et al. | 118/317 X |
| 4,532,885 | 8/1985 | Nunlist | 118/317 X |
| 5,259,880 | 11/1993 | Fujita et al. | 239/222.11 X |

*Primary Examiner*—Andres Kashnikow
*Assistant Examiner*—Lesley D. Morris
*Attorney, Agent, or Firm*—Zarley, McKee, Thomte, Voorhees, & Sease

[57] ABSTRACT

A sprayer for applying an uncured grout to the interior surface of an enclosed wall includes a sprayer motor having a rotor rotatably mounted within the motor housing. A spray head is attached to the rotor and a spray conduit is adapted to introduce fluid grout under pressure to the spray head so that it will be thrown radially outwardly in a circular pattern. The motor and spray head are inserted into a conduit and actuated to throw the grout outwardly on to the interior walls of the elongated conduit.

17 Claims, 4 Drawing Sheets

48
52
44
70
60
46
50
54
58
30
40
42
6
6
56
57
55
62
64
66
68
70

28
38
98
96
100
104
88
86
30
86
94
78
74
78
72
102
50
54
40
42
56
68
70
60
46
56
62
64
79
82
84
60
90
80
32
108
107
106
92
118
7
7
33
114
116
120
112
110

114
32
120
110
112
114
112
112
114

METHOD AND APPARATUS FOR SPRAYING GROUT ONTO THE INTERIOR SURFACE OF AN ENCLOSED ELONGATED CAVITY

BACKGROUND OF THE INVENTION

This invention relates to a method and apparatus for spraying grout onto the interior surface of an enclosed elongated cavity. By "spraying" is meant that the material is impelled or thrown onto the surface of the cavity. The invention has particular applicability for use in spraying first a washing fluid and then an uncured grout material onto the interior surfaces of manholes to be repaired. The invention also has application for the washing and grouting of the interior surfaces of elongated cavities having cylindrical, cone shaped, or other shaped surfaces.

One presently known method of repairing existing manholes is the placement of a coating of a cementatious grout onto the interior surface of the manhole wall. The grout is applied in an uncured state and is permitted to cure.

Presently known methods for applying the grout include the troweling of the grout onto the walls of the manhole and/or spraying the grout onto the wall of the manhole. In both of these cases it is necessary for the person applying the grout to enter into the manhole for either troweling or spraying the grout onto the walls. When the spraying method is used, a final troweling step usually is required in order to obtain the desired compaction, surface and thickness for the grout material.

One disadvantage of presently known methods for coating the interior surfaces of manholes with grout is the difficulty in obtaining a uniform thickness to the grout throughout the entire manhole. This can only be achieved by providing random measurements of the grouting or by providing lands extending radially inwardly from the manhole wall to show the desired thickness. When lands are used, they ultimately are embedded within the grout after the grout has been applied, and tend to weaken the grout and reduce its waterproofing characteristics.

Therefore, a primary object of the present invention is the provision of an improved method and apparatus for spraying grout onto the interior surface of an enclosed elongated cavity.

A further object of the present invention is the provision of a method and apparatus for spraying grout onto the interior of an enclosed elongated cavity which eliminates the need for the operator to enter into the cavity to accomplish the spraying.

A further object of the present invention is the provision of an improved method and apparatus for spraying grout onto the interior surface of an elongated cavity wherein a uniform thickness of grout may be applied over the entire wall of the enclosed elongated cavity.

A further object of the present invention is the provision of an improved method and apparatus for spraying grout onto the interior surface of an elongated cavity wherein the amount of grout may be carefully metered to determine the desired thickness of the grout on the cavity wall.

A further object of the present invention is the provision of an improved method and apparatus for spraying grout onto the interior surface of an elongated cavity which permits uniform application of grout around projections extending inwardly from the walls of the cavity.

A further object of the present invention is the provision of an improved method and apparatus for spraying grout onto the interior surface of an elongated cavity which propels the grout against the walls of the cavity in a circular pattern, and which permits the reversal of the rotational direction at which the grout is propelled against the walls of the cavity.

A further object of the present invention is the provision of an improved method and apparatus for spraying onto the interior surface of an elongated cavity which is efficient in operation, economical in manufacture, and durable in use.

SUMMARY OF THE INVENTION

The foregoing objects may be achieved by a spraying device for applying a fluid cementatious uncured grout to the interior surface of an enclosed wall forming an elongated cavity therein. The cavity includes an upstanding longitudinal axis, an upper end, and a lower end. The spraying device includes a pressurized source of fluid cementatious uncured grout. Such grouts are commonly known in the industry, and can be formed from various combinations of resinous materials, cementatious materials, aggregate materials, and/or reinforcing fibers or components. The present invention may also be used for applying paint, other chemicals or liquid materials onto the surface of a cavity. As used throughout this application the term grout refers to any of these materials which can be applied in an uncured state and which are capable of curing into a hardened surface once applied to the interior wall of the cavity.

The spraying device also includes a sprayer motor having a motor housing and a rotor rotatably mounted within the motor housing for rotation upon actuation of the motor. The motor may be air actuated, hydraulic actuated, or actuated by other means such as electricity.

A spray head or impeller is attached to the rotor of the motor for rotating in unison with the rotor when the motor is actuated. A spray conduit includes an inlet end connected to the pressurized source of grout and a discharge end connected to the motor housing and positioned adjacent the spray head for delivering the grout to the spray head during rotation of the spray head, whereby the spray head will throw the grout radially outwardly in a circular pattern.

The method of the present invention comprises placing the above described spraying device within the elongated cavity and spraying the grout radially outwardly in a circular pattern against the interior walls of the enclosed cavity.

DETAILED DESCRIPTION OF THE PREFERRED EMBODIMENT

Figure 1:
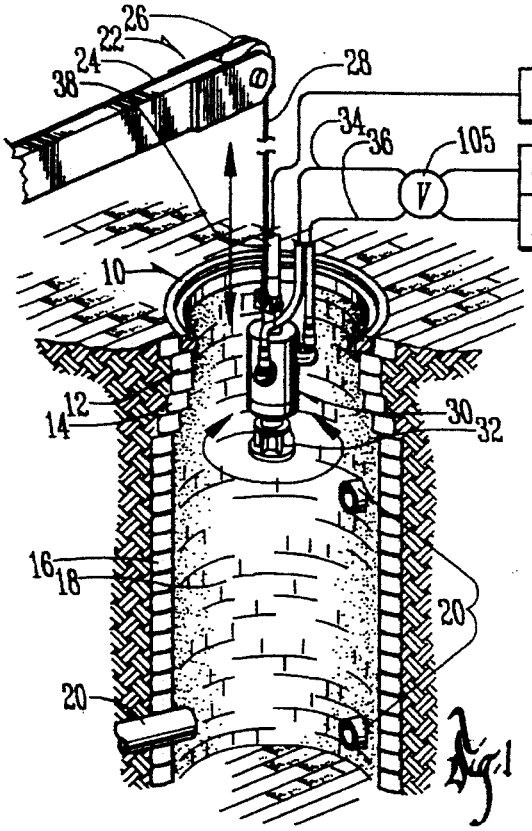
FIG. 1 is a pictorial representation of the use of the present invention in a manhole.

Referring to the drawings the numeral 10 generally designates a manhole. While a manhole is shown for illustrative purposes in the present application, the spraying device can also be used to spray grout to the interior of any enclosed wall forming an elongated cavity. Examples of such other applications might include standpipes, wells, chimneys, other enclosed cavity devices requiring repair. Manhole 10 includes a cylindrical chimney portion 12 below which is a cone shaped portion 14. Below the cone shaped portion 14 is an enlarged cylindrical portion 16, all of which form a manhole cavity 18. Several sewer pipes 20 are shown emptying into the manhole.

The numeral 22 generally designates a spraying apparatus which includes a boom 24 having a sheave 26 on its outer end and having a cable 28 extending downwardly therefrom. Attached to the lower end of the cable is a motor 30 having a spray head, impeller, or spreader 32. A pair of air lines 34, 36 are connected to the motor for driving the motor and a grout conduit 38 is connected to the motor for delivering grout under pressure to the motor.

Figure 4:
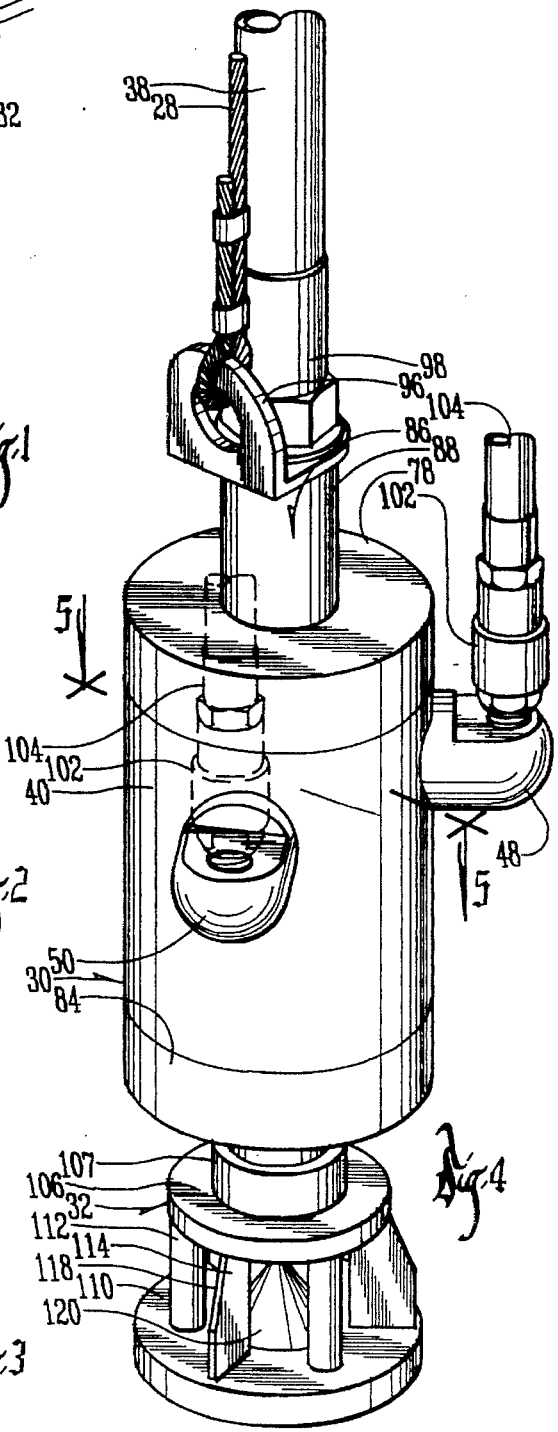
FIG. 4 is a pictorial view of the spraying device of the present invention.
Figures 5, 6, 7:
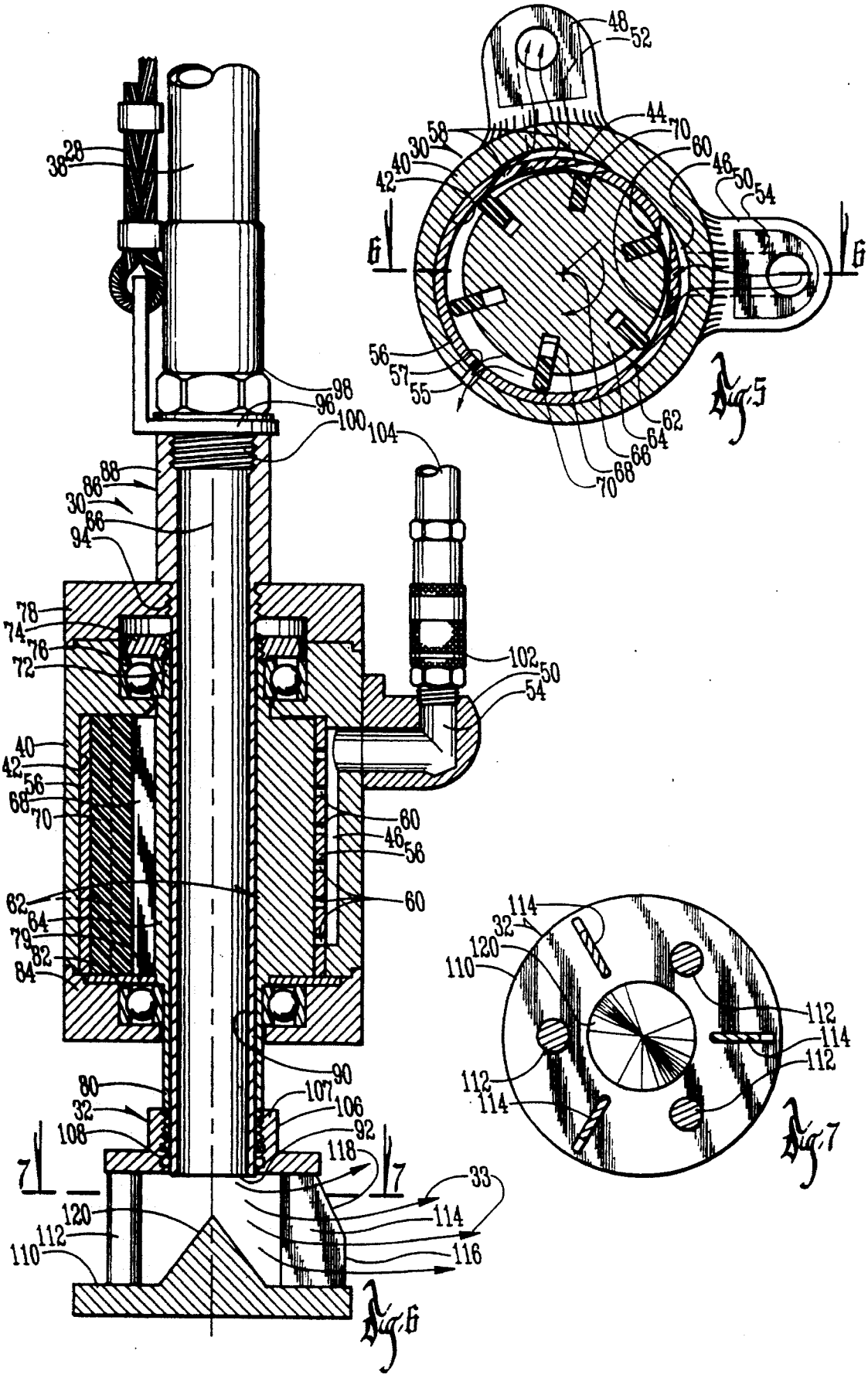
FIG. 5 is a sectional view taken along line 5—5 of FIG. 4.
FIG. 6 is a sectional view taken along line 6—6 of FIG. 5.
FIG. 7 is a sectional view taken along line 7—7 of FIG. 6.

Referring to FIGS. 4, 5 and 6, the motor 30 is comprised of an outer housing 40 having an eccentric housing bore 42 extending therethrough. Bore 42 is generally cylindrical in shape, but is offset from the central vertical axis 66 of the outer housing 40. Extending vertically along the cylindrical wall of the housing bore 42 are a pair of air manifolds 44, 46. A pair of air fittings 48, 50 are welded to the outside surface of the housing 40 and include air passageways 52, 54 communicating with the air manifolds 44, 46 respectively. On the opposite side of housing 40 is a vertical line of bleed ports 55 which provide communication from the housing bore 42 to the exterior of the housing.

Press fitted within the housing bore 42 is a cylindrical sleeve 56 having a vertical line of bleed ports 57 which are registered with the bleed ports 55. Sleeve 56 also includes two sets of vertical lines of air ports 58, 60. Bleed ports 58 are registered with the air manifold 44 and air ports 60 are registered with the air manifold 46. It should be noted that the air ports 58, 60 extend tangentially inwardly with respect to the cylindrical wall of the sleeve 56. There may be as many as four vertical rows for each of the ports 58, 60 or as few as one row for each group 58, 60.

Rotatably mounted within the sleeve 56 is a rotor 62. Rotor 62 is comprised of a cylindrical rotor body 64 having a plurality of radial slots 68 extending inwardly from the outer cylindrical walls of the rotor body 64. Slideably fitted within these radial slots are a plurality of blades 70 which are preferably constructed of plastic material. Blades 70 are free to slide radially inwardly and outwardly within the slots 68. Rotor 62 also includes an upwardly extending rotor stem 72 having a nut 74 threaded over the upper end thereof. Below nut 74 is an upper bearing 76 which permits the rotor 62 to rotate with respect to the housing 40. Attached over the top of the outer housing is a motor top plate 78.

Below the rotor body 64, of rotor 62 is a wear plate 79 against which the rotor body 64 rotates. Extending downwardly from the rotor body 64 is a lower rotor stem 80 which is threaded at its lower end. A bearing 82 is fitted within a motor bottom plate 84 and permits the rotation of the lower end of the rotor 62 with respect to the outer housing 40.

Threadably attached to the top plate 78 is a grout feed tube 86. Feed tube 86 includes an upper bushing portion 88 which is above the motor top plate 78 and a lower tube portion 90 which extends downwardly along the central axis 66 of the motor housing 40. The lower end of grout feed tube 86 includes a discharge opening 92. Adjacent the bushing portion 88 of grout feed tube 86 is a threaded shank 94 which is threaded within the top motor plate 78 so as to attach the grout feed tube 86 to the top motor plate 78.

A connector 98 includes a threaded shank 100 which is threaded within the upper end of bushing 88. A cable bracket 96 is embraced between the connector 98 and the bushing 88 and is adapted to be connected to the cable 28. Also connected to connector 98 is the grout conduit 38 which in turn is connected to a grout supply as indicated in FIG. 1. The grout supply is a pump for pumping grout downwardly into the grout feed tube 86. Numerous types of pumps are commercially available for this purpose.

Each of the air fittings 48, 50 are connected by means of a coupler 102 to an air hose 104 which in turn extends upwardly out of the manhole and is connected to a pressurized air supply. A valve 105 (FIG. 1) can be used to reverse the direction of the air flow within the two air lines 102. Thus it is possible to reverse the direction of air introduced to air fittings 48, 50.

Figure 2:
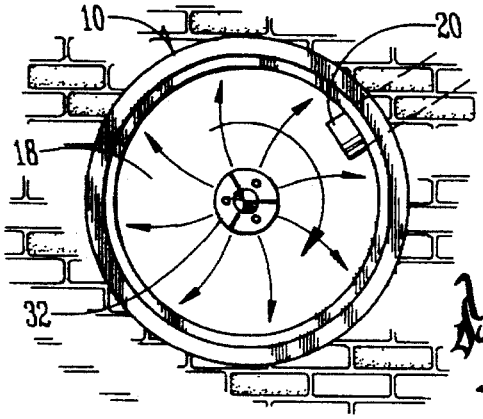
FIGS. 2 and 3 are top plan views of the manhole showing the operation of the spraying device in its two opposite rotational modes.

Sprayer head 32 is connected to the lower rotor stem 80 for rotation in unison with the rotor 62. Spray head 32 includes a sprayer top plate 106 having a threaded bushing 107 which is threaded onto the lower end of lower rotor stem 80. If desired, a locking ring (not shown) can be placed around the threaded connection between the bushing 107 and the rotor stem 80 to prevent unthreading during the reversal of the rotation of spray head 32. A seal 108 provides a sealing function between the bushing 107 and the stem 80. A sprayer bottom plate 110 is connected to the sprayer top plate 106 by means of three support posts 112 and three vertically extending blades 114. Each blade 114 lies in a plane which extends radially from the center line 66 of the motor 30. The outer radial edges of the blades 114 include a vertical edge 116 and a canted edge 118. The canting of edge 118 causes grout material to be thrown not only radially outwardly during rotation of the spray head 32, but also upwardly such as shown by arrows 33 in FIG. 2 so as to fill the spaces on the bottom edges of protrusions such as sewer pipes 20 shown in FIG. 1. Bottom plate 110 also includes a cone shaped center which urges the grout material radially outwardly as it falls from the discharge opening 92 of the grout feed tube 90.

In operation the two hoses 104 are connected to the source of pressurized air and the conduit 38 is connected to the grout supply as shown in FIG. 1. The motor 30 is lowered to the bottom of the manhole and the pressurized air is introduced into the motor through one of the fittings 48, 50. When the pressurized air is introduced through fitting 50, it enters the manifold 46 and passes through the tangential passageways 60 into the interior of the sleeve 56. The tangential arrangement of the passageways 60 causes the air to be driven in a clockwise direction as viewed in FIG. 5. As the air engages the vanes or blades 70 it imparts a clockwise rotation to the rotor 62. The rotation of rotor 62 causes the blades 70 to move radially outwardly as far as possible due to centrifugal force. A small amount of the pressurized air is permitted to bleed outwardly through bleed openings 57, 55, but at least some air continues traveling with the blades 70 until it exits through the tangential ports 58 into the air fitting 48 and returns to the inside of the pressurized air supply. It has been found that air pressure of 50 PSI will produce at least 3,000 RPMs, and rotational speed of the rotor can easily be increased to up to 5,000 RPMs or greater. The preferred range is 3,000 to 10,000 RPMs which has been found sufficient to create the impact velocities or pressures for placement of the grout onto the uneven surfaces of deteriorated structures.

The rotation of the rotor 62 causes the rotation of the spreader 32. Grout is introduced downwardly through lower tube portion 90 and outwardly through the discharge opening 92 where it falls upon the rotating spreader 32. The blades 114 engage the grout and throw it outwardly in a circular pattern against the walls of the manhole. The canted surfaces 118 permit the grouting material to be thrown at an inclined angle with respect to horizontal so as to cover the surfaces immediately below projections such as sewer pipes 20.

The motor 30 is then lifted upwardly along the longitudinal axis of the manhole so as to permit the spray to cover the entire surface of the manhole. It is possible to meter the amount of grout which has been sprayed, and by so doing to calculate the thickness of the grout on the manhole wall. Usually the motor must be raised and lowered in several cycles to achieve the desired thickness which may be from 1 to 3 inches.

Figure 3:
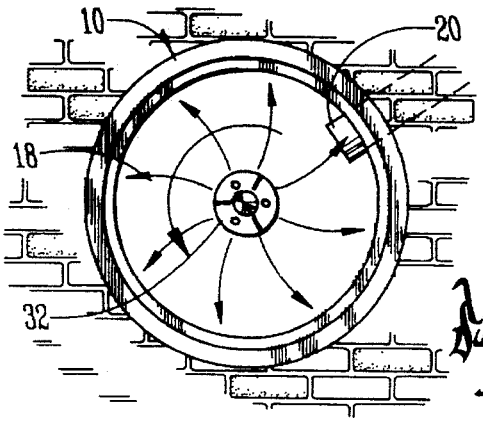

During a portion of the coating process it may be desirable to reverse the rotational direction of the rotor. This can be done by changing valve 105 so as to reverse the direction of air pressure so that pressurized air is introduced into fitting 48 and is exhausted through fitting 50. The advantage of reversing the rotational direction of the rotor is that it permits the grout to be evenly applied on both sides of the inward projections such as sewer pipes 20 shown in FIGS. 2 and 3. If only one rotational direction is used, the manhole wall on the downstream side of the sewer pipe 20 is not likely to receive as complete a coating as the manhole wall on the upstream side.

It is thus possible to provide a coating for the interior surface of the manhole without the necessity of the operator entering the manhole. Instead the motor is raised and lowered until the desired coating is achieved. Furthermore, a uniform coating is achieved along the entire surface of the manhole and troweling is not required after the grouting has been applied.

Figures 8, 9:
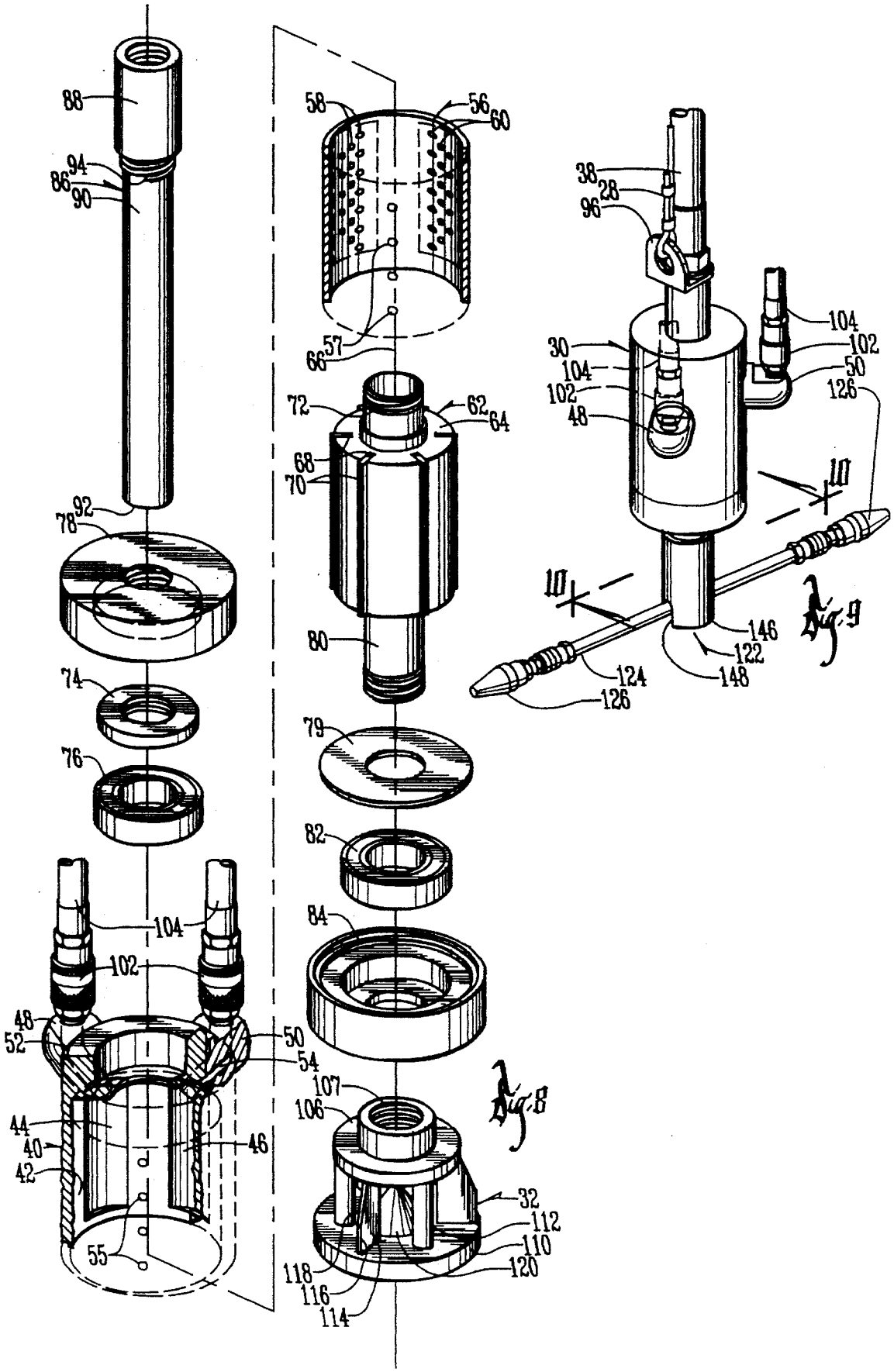
FIG. 8 is an exploded perspective view of the spraying device of the present invention.
FIG. 9 is a pictorial view of the spraying device of the present invention, utilizing a washing sprayer head in the place of a grout spraying head.
Figure 10:
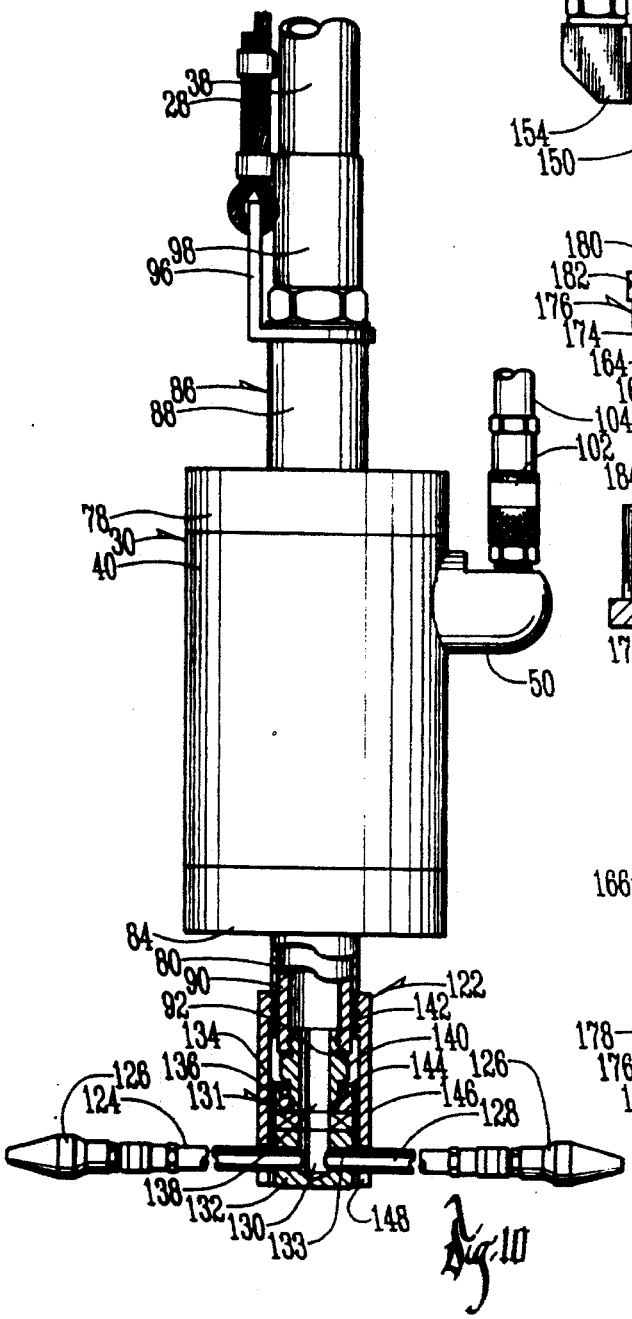
FIG. 10 is a front elevational view of the device shown in FIG. 9, with a portion shown in section along line 10—10.

Referring to FIG. 9 a washing spray head 122 may be attached to motor 30 in the place of the spray head 32. Spray head 32 is merely unthreaded off the lower end of the rotor stem 80, and replaced with the washing spray head 122. Spray head 122 is comprised of a sprayer bar 124 having spray nozzles 126 at its opposite ends. A hollow bore 128 extends through the sprayer bar and includes a central port 130 at the center of the bar 124.

Sprayer bar 124 is attached to the lower end of a swivel connector 131 by means of a bore 133 which extends through a bottom swivel member 132 of swivel connector 131. Swivel connector 131 also includes a top swivel member 134 which is rotationally joined to bottom swivel member 132 by a swivel bearing 136. A vertical passageway 138 extends through the swivel connector 131 and is in communication through central port 130 to the interior hollow bore 128 of sprayer bar 124.

Threaded within the upper end of vertical passageway 138 is a ferrule 140 which includes an upper threaded end 142 and a lower threaded end 144. The lower threaded end 144 is threaded within the passageway 138 and the upper threaded end 142 is threaded within the lower open end 92 of the grout feeder tube 86. Thus the sprayer bore 124 is in communication with the interior of the grout feed tube 86, but is permitted to rotate with respect to the grout tube 86 by means of the bearing 136. The grout conduit 138 is adapted to be connected to a pressurized source of water or other cleaning fluid so that the water or cleaning fluid can be introduced to the nozzles 126 of the sprayer bar 124.

The rotation of sprayer bar 124 is caused by its connection to the lower rotor stem 80 by means of the drive sleeve 146 which is threaded on to the lower end of lower rotor stem 80. Drive sleeve 146 includes a pair of slots 148 at its lower end which embrace the sprayer bar 124. Thus water can be introduced to the sprayer bar 124 and air can be introduced to the motor to rotate the sprayer bar in the same manner as described above for the grout spreader.

The washer spray head 122 can be used at the beginning of the operation to wash the walls of the manhole before the application of grout. High pressures of washing fluid can be introduced to the washer spray head, and the rotation of the washer spray head and the pressure induced from the pressure source causes the washing fluid to be sprayed against the walls of the manhole for cleaning the walls. After washing the walls, pressurized air may be introduced to the spray head 122 for removing excess water from the cavity walls.

Figure 11:
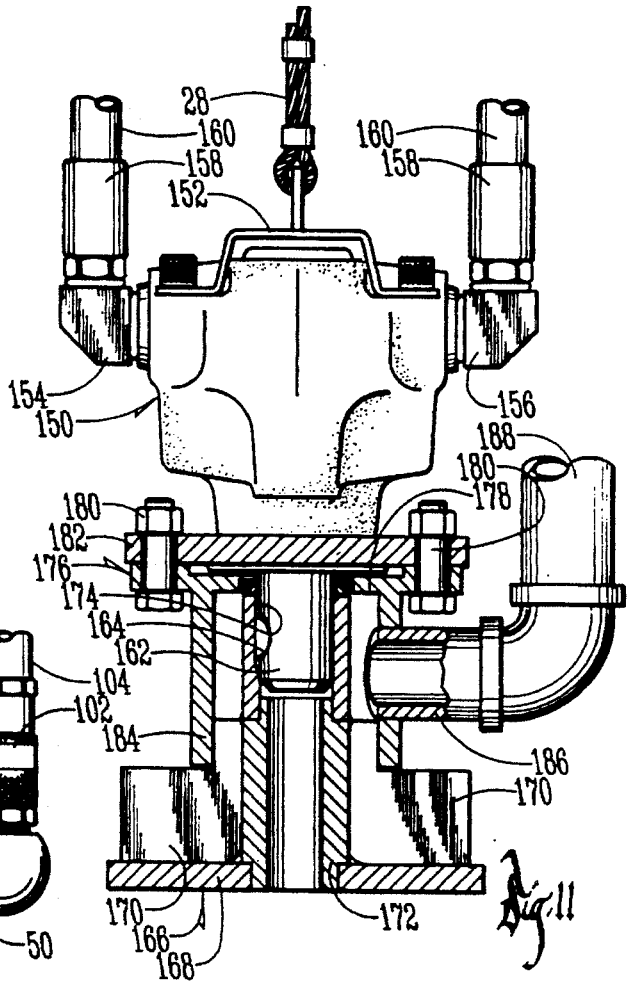
FIG. 11 is an elevational view, shown partially in cross section, of a modified form of the present invention.
Figure 12:
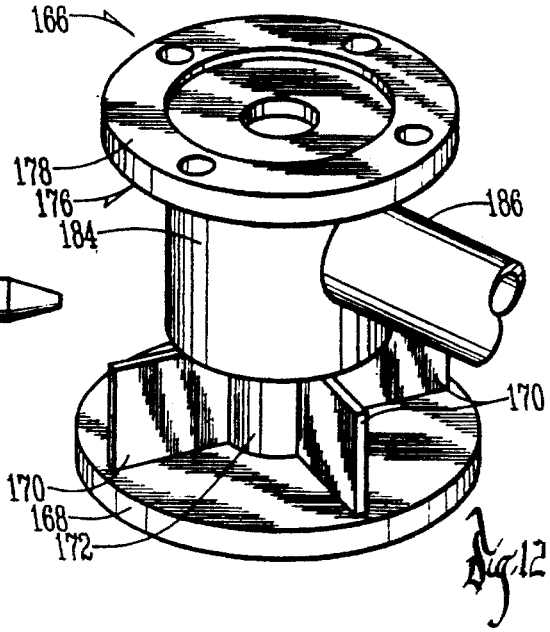
FIG. 12 is an enlarged pictorial view of the sprayer head shown in FIG. 11

Referring to FIGS. 11 and 12 a modified form of the invention is shown utilizing a hydraulic motor 150 in the place of the pneumatically driven motor 30 shown in FIGS. 1–10. Motor 150 should be a reversible hydraulic motor, and numerous such reversible hydraulic motors are commercially available. An example of a preferred motor is manufactured by Gresen Company under the model designation MGG2.

Motor 150 is connected to cable 28 by means of a bracket 152. Motor 150 includes two hydraulic fittings 154, 156 each of which is connected to a hydraulic coupler 158, and a hydraulic line 160. Motor 150 includes an output shaft 162 which is adapted to be driven at RPMs in the range of from 3,000 to 6,000 RPMs. A keyway 164 is provided in the output shaft 162. Mounted to the output shaft 162 is a spray head 166. Spray head 166 includes a bottom plate 168 having a plurality of vanes 170 which are connected to an upwardly extending central tube 172. Tube 172 includes a rib or dimple 174 which is mated within the keyway 164 of output shaft 162. It is secured to the output shaft 162 by a set screw (not shown) or other conventional fastening means.

A skirt assembly 176 includes a mounting plate 178 which is mounted to a motor plate 182 on motor 150 by means of a plurality of bolts 180. Extending downwardly from the mounting plate 178 is a cylindrical skirt 184 having a grout fitting 186 extending radially outwardly therefrom. A grout feed hose 188 is connected to the grout fitting 186 and is adapted to introduce grout under pressure into the area surrounded by the cylindrical skirt 184.

In operation the hydraulic motor 150 is actuated to rotate shaft 162 which in turn rotates the spray head 166. The grout is introduced through grout fitting 186 into the area within skirt 184 above the vanes 170. As the grout falls onto the vanes 170 it is thrown radially outwardly in a circular pattern. The rotational direction of the motor may be reversed by reversing the flow of hydraulic fluid through the hydraulic lines 160.

While pneumatic and hydraulic motors have been shown for the present invention it is also possible that other types of motors such as electric motors could be used without detracting from the invention.

In the drawings and specification there has been set forth a preferred embodiment of the invention, and although specific terms are employed, these are used in a generic and descriptive sense only and not for purposes of limitation, Changes in the form and the proportion of parts as well as in the substitution of equivalents are contemplated as circumstances may suggest or render expedient without departing from the spirit or scope of the invention as further defined in the following claims.

What is claimed is:

1. A method for applying a grout comprised of fluid uncured hardenable material to an interior surface of an enclosed wall forming an elongated cavity therein having a longitudinal axis, said enclosed wall having at least one projection extending radially inwardly therefrom, said method comprising:

placing a spraying device within said elongated cavity, said spraying device having a grout input, a grout output, and a rotatable spreader adjacent said grout output;

introducing a fluid uncured cementatious grout to said grout input of said spraying device under pressure whereby said grout is forced outwardly from said grout output and into engagement with said rotatable spreader;

rotating said rotatable spreader in a first direction with sufficient velocity to cause said grout to be thrown radially outwardly into engagement with, and to adhere to said internal surface of said enclosed wall and to at least a portion of said projection;

reversing the rotational direction to a second direction opposite from said first direction with sufficient velocity to cause said grout to be thrown radially into engagement with, and to adhere to said internal surface of said enclosed wall and to at least another portion of said projection.

2. A method according to claim 1 and further comprising moving said spraying device in an axial direction within said elongated cavity during said introducing, rotating and reversing steps whereby grout will be thrown against and will adhere to at least a portion of the length of said interior surface of said enclosed wall.

3. A method according to claim 2 and further comprising moving said spraying device back and forth axially within said cavity during said introducing, rotating and reversing steps until a desired thickness of said grout has been adhered to said interior surface of said enclosed wall.

4. A method according to claim 1 and further comprising using said rotatable spreader during said spreading step to throw at least a portion of said grout at an angle which is inclined with respect to a plane perpendicular to said longitudinal axis of said elongated cavity.

5. A method according to claim 4 wherein said throwing of said grout is accomplished by engaging said grout with a plurality of fins on said spreader, each of said fins lying in a plane which extends in a radial direction from the rotational axis of said spreader; at least some of said fins having an outer radial edge which includes a vertical portion and a canted portion.

6. A method according to claim 1 wherein said rotation step and said reversing step are caused by actuating a reversible motor within said enclosed wall and reversing said reversible motor within said enclosed wall respectively.

7. A method for applying a grout comprised of fluid uncured cementatious material to an uneven interior deteriorated surface of an existing manhole needing repair, said manhole having an upper end and a lower end, said method comprising:

suspending a single spraying device completely within said manhole in a position wherein said entire spraying device is free from engagement with said deteriorated surface of said manhole, said spraying device having a grout input, a grout output, a single rotatable spreader adjacent said grout output, and a motor drivingly connected to said spreader;

introducing a fluid uncured cementatious grout to said grout input of said spraying device under pressure whereby said grout is forced outwardly from said grout output and into engagement with said rotatable spreader;

rotating said rotatable spreader;

increasing the rotational velocity of said spreader to a desired rotational velocity relative to the shape and size of said manhole, said desired rotational velocity being sufficient to cause said grout to be thrown radially outwardly to impact and adhere to said uneven interior surface of said manhole;

raising and lowering said rotatable spreader within said manhole between said upper and said lower ends thereof so as to achieve a uniform coating of said grout with a desired thickness on said interior deteriorated surface of said manhole.

8. A method according to claim 7 and further comprising rotating said spreader in a first direction and then reversing the rotational direction of said spreader.

9. A method according to claim 7 and further comprising increasing said rotational velocity to said desired rotational velocity of between 3,000 rpm's and 10,000 rpm's.

10. A spraying device for applying a grout comprised of a fluid uncured hardenable material to an interior surface of an enclosed wall forming an elongated cavity therein; said elongated cavity having a longitudinal axis, said spraying device comprising:

a sprayer motor having a motor housing and a rotor rotatably mounted within said motor housing for rotation upon actuation of said motor, said motor being reversible to reverse the rotational direction in which said rotor is driven;

a sprayer conduit connected to said motor and having an inlet opening and an outlet opening;

a second conduit having a first end connected to said inlet opening of said sprayer conduit and having a second end for connection to a pressurized source of said fluid uncured grout whereby said grout will be forced through said second conduit and said sprayer conduit and will exit from said outlet opening of said sprayer conduit;

a spray head attached to said rotor and positioned adjacent said outlet opening of said grout conduit for rotating with said rotor and for engaging said grout exiting from said outlet end of said sprayer conduit;

said spray head having fins thereon for engaging said grout exiting from said outlet end of said spray conduit and for throwing said grout radially outwardly in a circular path during rotation of said rotor and said spray head.

11. A spraying device according to claim 10 wherein said motor is a hydraulically powered motor.

12. A spraying device according to claim 10 wherein said motor is a pneumatically powered motor.

13. A spraying device according to claim 10 wherein said spray conduit extends through said motor.

14. A spraying device according to claim 10 wherein said rotor rotates about a rotor axis, said spray conduit extending along said rotor axis.

15. A spraying device according to claim 10 wherein each of said fins includes an outer radial edge comprising a first portion parallel to the rotational axis of said spray head and a second portion canted with respect to the rotational axis of said spray head whereby said grout will be thrown radially outwardly and an inclined angle with respect to said rotational axis during rotation of said rotor and said spray head.

16. A spraying device for applying a grout comprised of a fluid uncured hardenable material to an interior surface of an enclosed wall forming an elongated cavity therein; said elongated cavity having a longitudinal axis, said spraying device comprising:

a sprayer motor having a motor housing and a rotor rotatably mounted within said motor housing for rotation upon actuation of said motor;

a sprayer conduit connected to said motor and having an inlet opening and an outlet opening;

a second conduit having a first end connected to said inlet opening of said sprayer conduit and having a second end for connection to a pressurized source of said fluid uncured grout whereby said grout will be forced through said second conduit and said sprayer conduit and will exit from said outlet opening of said sprayer conduit;

a spray head attached to said rotor and positioned adjacent said outlet opening of said grout conduit for rotating with said rotor and for engaging said grout exiting from said outlet end of said sprayer conduit;

said spray head having fins thereon for engaging said grout exiting from said outlet end of said spray conduit and for throwing said grout radially outwardly in a circular path during rotation of said rotor and said spray head said spray head being detachable from said rotor;

a fluid sprayer capable of attachment to said rotor and said outlet end of said sprayer conduit for rotation with said rotor;

said conduit being connectable to a source of pressurized cleaning fluid for introducing pressurized cleaning fluid to said fluid sprayer.

17. A spraying device according to claim 16 wherein said fluid sprayer comprises at least one nozzle adapted to spray said cleaning fluid radially outwardly toward said interior surface of said enclosed wall when said fluid sprayer is within said elongated cavity and is rotating.

* * * * *